United States Patent [19]

Bernhardt et al.

[11] Patent Number: 4,852,217

[45] Date of Patent: Aug. 1, 1989

[54] CARDER FOR MANUFACTURING NON-WOVENS FROM FIBROUS MATERIAL

[76] Inventors: Siegfried Bernhardt, Sandesch 5, D2820 Bremen 71; Alfred Knake, Samlandstr. 43, 2820 Bremen 71; Hans Schmiedgen, Korbweide 15, D2820 Bremen 70, all of Fed. Rep. of Germany

[21] Appl. No.: 133,423

[22] Filed: Dec. 15, 1987

[30] Foreign Application Priority Data

Dec. 18, 1986 [DE] Fed. Rep. of Germany ..... 3643304

[51] Int. Cl.[4] ..... D01G 15/00; D01G 15/46

[52] U.S. Cl. ..... 19/98; 19/106 R

[58] Field of Search ..... 19/98, 106 R

[56] References Cited

U.S. PATENT DOCUMENTS 4,523,350 6/1985 Schmiedgen et al. ..... 19/98
4,599,766 7/1986 Wirth ..... 19/106 R
4,723,343 2/1988 Bernhardt ..... 19/98

FOREIGN PATENT DOCUMENTS 3224118 1/1984 Fed. Rep. of Germany .
3315839 11/1984 Fed. Rep. of Germany .
3532021 6/1987 Fed. Rep. of Germany .

*Primary Examiner*—Werner H. Schroeder
*Assistant Examiner*—Sara M. Current
*Attorney, Agent, or Firm*—Hill, Van Santen, Steadman & Simpson

[57] ABSTRACT

A carder for manufacturing non-woven materials from fibrous material which includes at least one draw-in roller, and a licker-in roller following the draw-in roller and rotating in the same direction. There are at least two worker rollers of the same diameter following the licker-in roller, the two worker rollers rotating in the same direction and at a greater speed than the licker-in roller. At least one doffing cylinder cooperates with the last of the worker rollers. Further worker rollers follow the two worker rollers, with the various worker rollers being separated by transfer regions between adjacent rollers. The relative speeds and the spacings between adjacent rollers are adjustable to control the proportion of fibrous material that can be returned to previous worker rollers or sent to succeeding worker rollers. An air-guiding box projects into at least one of the transfer regions, the box being adjustable in height and width.

4 Claims, 3 Drawing Sheets

CARDER FOR MANUFACTURING NON-WOVENS FROM FIBROUS MATERIAL

BACKGROUND OF THE INVENTION

1. Field of the Invention

The present invention is directed to a carder for manufacturing non-woven fabrics from fibrous material which is provided with an air-guiding box to improve the uniformity and the non-woven structure of the fibrous material.

2. DESCRIPTION OF THE PRIOR ART

U.S. Pat. No. 4,523,350, the disclosure of which is hereby incorporated by reference, discloses a carder wherein the worker rollers following the licker-in roller are provided as a main roller comprising a subsequent matting roller and being preceded by at least one pair of worker rollers and clearer rollers. The worker and clearer rollers which generally have a smaller diameter than the main matting roller or rollers in the apparatus described thereby serve the purpose of managing an adequate carding of the fibrous material, whereas the matting roller or rollers achieve an optimum uniformity of the matted non-woven structure over the entire width of the non-woven material to be manufactured. The fabric which results has the generally desirable characteristic of having a ratio of longitudinal strength to transverse strength at about 1:1 over the entire extent of the non-woven fabric.

The carder described in the aforementioned patents has proven itself commercially. As a result of the increased tendency to increase the working width of the carders, however, it has been found that the use of the worker rollers and clearer rollers necessarily having a relatively small diameter in comparison to the main rollers involves greater and greater difficulties. For example, with a width of 4 meters or more, sags of the rollers are unavoidable. Further, the structural outlay is relatively great as a consequence of the numerous, different circumferential speeds of the rollers of different diameters such as the main rollers, matting rollers, as well as the worker, and clearer rollers.

The art discloses a carder where, unlike the carder mentioned above, the worker rollers following one another rotate in opposite directions and clearer rollers are provided which have a smaller diameter than the worker rollers. This system has the disadvantage that the individual worker rollers must exhibit an increased speed so that the carding effect obtainable for the number of possible worker rollers following one another is limited since it is difficult to achieve such increased speeds.

In order to improve the uniformity of the matted non-woven structure over the entire width of the fabric with reduced structural outlay and high working speeds, U.S. Pat. No. 4,723,343 proposes a carder wherein a satisfactory carding effect and uniformity of the non-woven fabric can be achieved over the full width wherein the fibrous material is conducted with adjustable, partial back-storing over at least three workers of identical diameter positioned in mutual, adjustable engagement with each other. Combined with the adjustability of the relative speeds as well as the relative positions of the individual worker rollers, a controllable back-storing is thus achieved at each individual worker roller, the surface structure being shaped in the form of saw tooth fittings or the like.

U.S. Pat. No. 4,723,343 discloses wherein a wedge shaped air-guiding box projects into the transfer region between the main roller and the matting roller, the air-guiding box being adjustable in height and transversely relative to the roller shell. The air-guiding box can be either pressurized or unpressurized but can not be charged with a vacuum for suctioning. It improves the strong air turbulences present in the area between the cooperating worker rollers in which the non-woven fabric is formed, so that an optimum and uniform non-woven formation is promoted.

SUMMARY OF THE INVENTION

The present, invention provides a carder of the type shown in U.S. Pat. No. 4,723,343 while improving the process of forming matted non-woven materials in the transfer region between cooperating worker rollers. This objective is achieved by providing an air-guiding box projecting essentially wedge shaped into the transfer region and being adjustable in height and transversely relative to the roller shell. This air-guiding box is associated with at least one of the transfer regions between the worker rollers cooperating with each other.

The air-guiding box is made hollow and is provided with pipe unions at its lateral faces which extend perpendicular to the roller shell. The box can be provided with air passage openings on at least one surface which face toward the worker rollers and can be supplied with compressed air.

In a preferred embodiment of the invention, the surface of the air-guiding box which points directly to the transfer region between the worker rollers is provided with air passage openings. In another preferred form of the invention, the surface or surfaces of the air-guiding box are provided with air passage openings which have sliding panels which are selectively seated against the surface or surfaces and are provided with air pressure holes.

The structure of the present invention thus provides an air-guiding box in the carder of U.S. Pat. No. 4,723,343 and U.S. Pat. No. 4,523,350. The carder of the invention improves the formation of matted non-woven material in the transfer region to which the air-guiding box is associated or in the transfer regions to which the air-guiding box is positioned between successive worker rollers.

DESCRIPTION OF THE PREFERRED EMBODIMENTS

Figure 1:
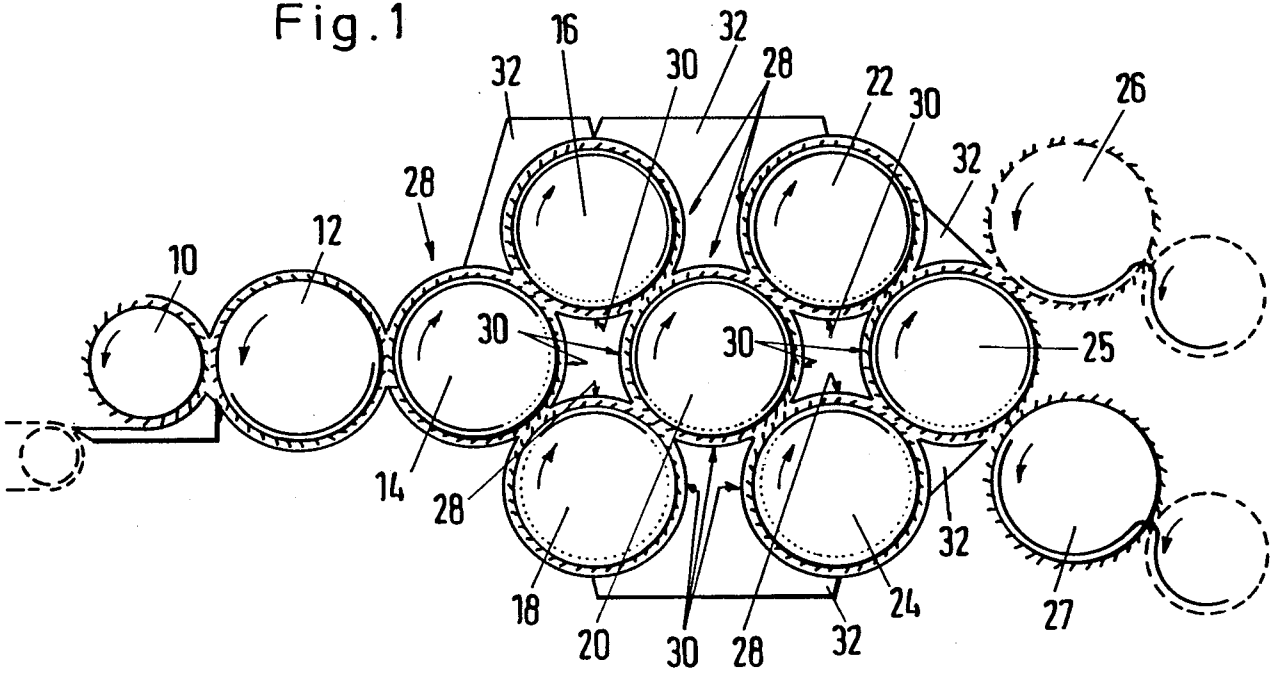
FIG. 1 illustrates an example of a carder of the present invention in a schematic cross-sectional view perpendicular to the rotational axis of the machine rollers.

In FIG. 1, there is shown a draw-in roller 10 which may cooperate with a draw-in trough or the like in delivering fibrous materials to the rollers. Of course, a plurality of draw-in rollers or a plurality of troughs can also be provided. The draw-in roller 10, for example, operates with a peripheral speed of 10 meters per minute and charges a licker-in roller 12 running in the same direction at a rotational speed, for example, of about 300 meters per minute. The licker-in roller 12 thus rotates in the same direction as the draw-in roller 10 and whose surface, like that of the draw-in roller 10 and succeeding rollers, can be provided with an appropriately shaped saw tooth configuration. The licker-in roller 12 is followed by a first worker roller 14 rotating in the opposite direction which, in turn, cooperates with a second worker roller 16 as well as with a third worker roller 18. The second worker roller 16 and the third worker roller 18 charge a fourth worker roller 20 which is followed by a fifth worker roller 22 as well as by a sixth worker roller 24. The fifth worker roller 22 and the sixth worker roller 24 are followed in common by a seventh worker roller 25. The worker rollers 14, 16, 18, 20, 22, 24 and 25 each may have a tangential speed, for example, of about 1400 meters per minute. The relative speeds of the worker rollers are adjustable as are the relative spacings, i.e., the width of the respective roller nips. The worker rollers 14, 16, 18, 20, 22, 24 and 25 are followed by two doffing cylinders 26, 27 in the manner shown in the drawing. These doffing cylinders 26, 27 run in a direction opposite to the direction of the worker rollers and may have a tangential speed, for example, of about 116 meters per minute.

The drawing also illustrates transfer regions 28 in which a transfer of the fibrous material occurs as well as storage regions 30 for the fibrous material on the individual worker rollers. The drawing also shows air-guiding boxes conforming to the shape of the respective worker rollers and extending wedge-like into the transfer regions between the pair of cooperating worker rollers.

The carder shown in FIG. 1 operates in the following way. The drawing-in roller 10 conveys fibrous material onto the licker-in roller 12 in a uniform feed. The first worker roller 14 running in the opposite direction takes the fibrous material from the licker-in roller 12 with considerable draft (preferably between 100 and 200) and cards it in a first step in cooperation with the second worker roller 16 and the third worker roller 18. Not all of the fibrous material taken from the licker-in roller 12 by the first worker roller 14 is immediately transferred onto the second worker roller 16 or onto the third worker roller 18. On the contrary, as may be seen from the drawing, only that part present in the transfer region 28 is transferred whereas the part of the fibrous material present in the storage region 30 is returned once again for further carding. The same conditions also obtain between the further worker rollers 20, 22, 24 and 25 following the worker rollers 16, 18. Accordingly, the proportion of the fibrous material which is transferred and stored back is adjustable on the basis of an appropriate control of the relative spacings between the respective worker rollers, or the relative speeds thereof Finally, the doffing cylinder 26 or other suitable take-off mechanism runs considerably slower than the worker rollers, so that a relatively greatly "telescoped" non-woven fabric is pushed thereon.

The air-guiding boxes 32 which may be unpressurized or charged with compressed air as shown in German patent No. 33 15 839, create great turbulences in the transfer regions between the respective worker rollers cooperating with one another. The air-guiding box forms a resistance for air movement and is additionally influenced with positively pressured compressed air charging of the air-guiding boxes. The intensity of the air stream or the overall influencing of the turbulence achieved in the transfer regions influences the uniformity and has a direct, overall influence on the matted non-woven structure of the fibrous material located there. The air-guiding box or boxes provided in the various transfer regions, however, not only enable the turbulences in the respective transfer regions to be influenced but permit the pre-carded material to be combined with additional amounts of fibrous material as well as with powder, granules, or the like added in those regions, as disclosed overall by German patent No. 33 15 839.

The fibrous material obtained with the carder of the present invention as shown in FIG. 1 is uniform over the full working width of the machine and has a ratio of longitudinal strength to transverse strength of about 1:1. The worker rollers of identical diameter can be made sag-free even with very large working widths of the machine. In addition to eliminating the problem of roller sag, the elimination of worker and clearer rollers assures a considerably simpler structural format.

Figure 2:
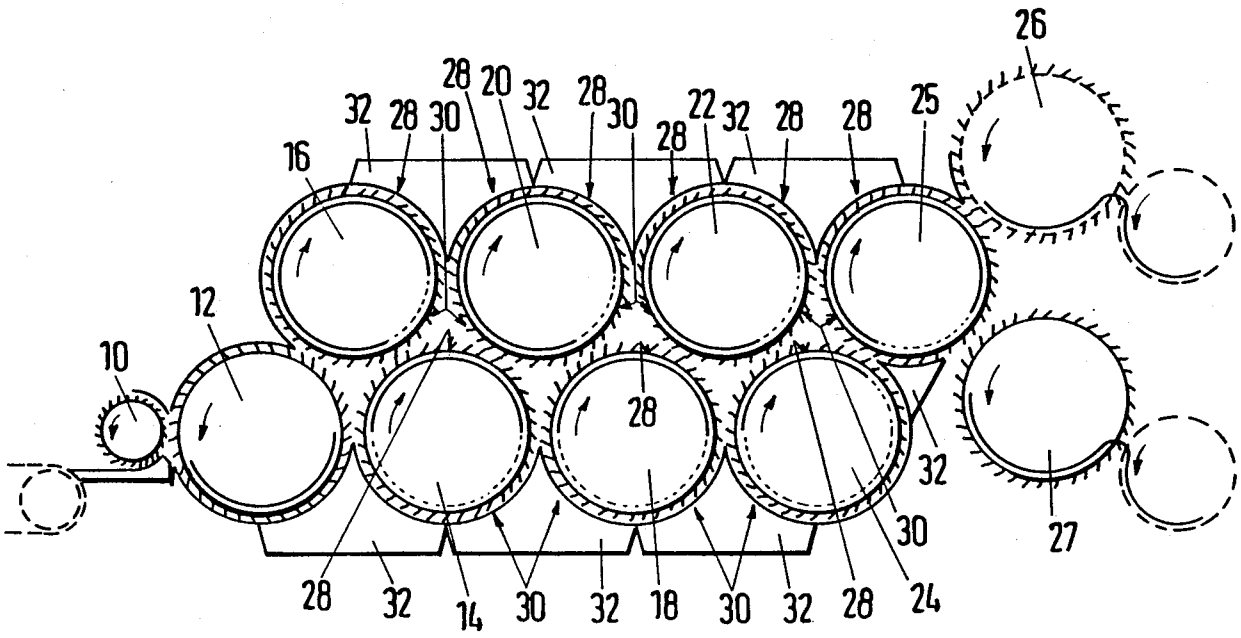
FIG. 2 shows another embodiment of the present invention.
Figure 3:
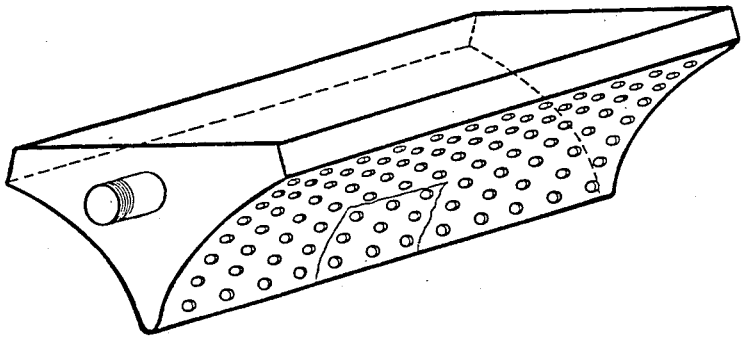
Figure 4:
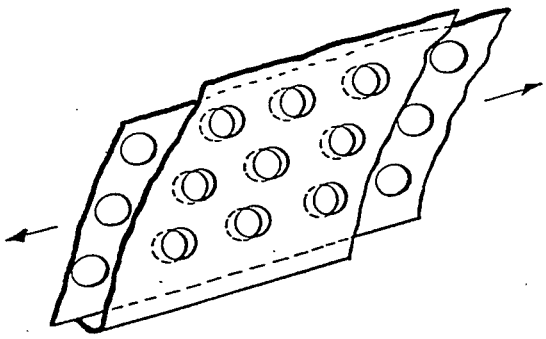

In the embodiment shown in FIG. 2, two worker rollers 14, 16 cooperate with the licker-in roller 12. The licker-rollers 14, 16 are followed by further worker rollers 18, 20, 22, 24 and 25 which cooperate with each other such that the fibrous material delivered from the draw-in roller 10 is forwarded or stored back to the desired degree by the individual worker rollers. The rotational speeds of the draw-in roller 10, of the licker-in roller 12 running in the same direction as the draw-in roller, as well as the worker rollers 12, 14, 16, 20, 22, 24 and 25 which run in the opposite direction and of the doffing cylinders 26, 27 may be commensurate with the values recited in connection with FIG. 1. The apparatus of FIG. 2 operates in the same fashion recited in more detail with reference to the embodiment of FIG. 1.

It should be recognized that the various features described herein can be used individually as well as in arbitrary combinations of the various embodiments.

We claim as our invention:

1. A carder for manufacturing non-woven materials from fibrous material comprising:

at least one draw-in roller, a licker-in roller following said draw-in roller and rotating in the same direction, at least two worker rollers of the same diameter following said licker-in roller, said two worker rollers rotating in the same direction and at a greater speed than said licker-in roller, at least one doffing cylinder cooperating with the last of said worker rollers, a further worker roller following said two worker rollers, the worker rollers being separated by transfer regions between adjacent roller, the relative speeds of the worker rollers being adjustable to control the proportion of fibrous material that can be returned to previous worker rollers and succeeding worker rollers, and air-guiding box members projecting into said transfer regions between said worker rollers for effecting air turbulence in the transfer regions.

2. A carder according to claim 1, wherein the relative spacing between said worker rollers is adjustable to control the proportion of fibrous material that is proportioned between previous worker rollers and succeeding worker rollers.

3. A carder according to claim I, wherein each air-guiding box is hollow and is provided with air passage openings for discharging air therefrom.

4. A carder according to claim 3, wherein said air-guiding box has sliding panels cooperating with said air passage openings to govern the flow of air therethrough.

* * * * *